US007466934B2

(12) United States Patent
Chae et al.

(10) Patent No.: US 7,466,934 B2
(45) Date of Patent: Dec. 16, 2008

(54) METHOD AND APPARATUS TO CONTROL FUSING TEMPERATURE OF AN IMAGE FORMING APPARATUS

(75) Inventors: Seok-heon Chae, Suwon-si (KR); Bong-hee Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 342 days.

(21) Appl. No.: 10/940,949

(22) Filed: Sep. 15, 2004

(65) Prior Publication Data

US 2005/0105929 A1 May 19, 2005

(30) Foreign Application Priority Data

Nov. 18, 2003 (KR) ..... 10-2003-0081727

(51) Int. Cl.
*G03G 15/20* (2006.01)
*G03G 21/20* (2006.01)

(52) U.S. Cl. ..... 399/69; 399/92

(58) Field of Classification Search ..... 399/69, 399/92

See application file for complete search history.

(56) References Cited

U.S. PATENT DOCUMENTS 5,144,366 A * 9/1992 Sakamoto et al. ..... 399/92

FOREIGN PATENT DOCUMENTS

| | | | |
|---|---|---|---|
| EP | 1164440 A1 | | 3/2000 |
| JP | 01164232 A | * | 6/1989 |
| JP | 05119669 A | * | 5/1993 |
| JP | 05-190303 | | 7/1993 |
| JP | 2002328562 A | * | 11/2002 |
| JP | 2003015464 A | * | 1/2003 |
| KR | 21894 A | | 4/2000 |
| KR | 2001-0105224 A | | 11/2001 |

* cited by examiner

*Primary Examiner*—Ryan Gleitz
(74) *Attorney, Agent, or Firm*—Stanzione & Kim, LLP

(57) ABSTRACT

A method and apparatus to control the fusing temperature of an image forming apparatus. This method of controlling the fusing temperature of an image forming apparatus having a fan to exhaust the internal air to the outside includes counting the accumulated number of sheets of paper printed in response to print commands, lowering a set point of the fusing temperature and controlling the fan to increase the amount of air to be exhausted when the accumulated number of sheets of printed paper is greater than a predetermined value. According to the method, without installing an additional temperature sensor inside the image forming apparatus, the temperature therein can be presumed and controlled by controlling the fusing temperature of the fusing roller and a fan flow rate to lower the temperature of the paper, and consequently, preventing the formation of creases in the paper.

15 Claims, 3 Drawing Sheets

METHOD AND APPARATUS TO CONTROL FUSING TEMPERATURE OF AN IMAGE FORMING APPARATUS

CROSS-REFERENCE TO RELATED APPLICATIONS

This application claims the priority of Korean Patent Application No. 2003-81727, filed on Nov. 18, 2003, in the Korean Intellectual Property Office, the disclosure of which is incorporated herein in its entirety and by reference.

BACKGROUND OF THE INVENTION

1. Field of the Invention

The present general inventive concept relates to a method and apparatus to control the fusing temperature of an image forming apparatus, and, more particularly, to a method and apparatus to control the fusing temperature of an image forming apparatus that adjusts a fusing temperature and a fan flow rate as the number of sheets of paper printed continuously increases.

2. Description of the Related Art

An electrophotographic image forming apparatus includes a fixing apparatus, which heats a sheet of paper having a toner image transferred, fuses the toner image in a powder state, and fixes the toner image on the sheet of paper. The fixing apparatus includes a fusing roller for fixing toner on the sheet of paper and a pressure roller for pressing the sheet of paper against the fusing roller.

FIG. 1 is a horizontal sectional view of a conventional fusing roller using a halogen lamp as a heat source. FIG. 2 is a vertical sectional view of a fixing apparatus adopting the fusing roller shown in FIG. 1.

Referring to FIG. 1, the fusing roller 10 includes a cylindrical roller 11 and a halogen lamp 12 installed in the middle of the cylindrical roller 11. A teflon coating layer 11 a is formed on the surface of the cylindrical roller 11. The halogen lamp 12 generates heat inside the cylindrical roller 11, and the cylindrical roller 11 is heated by radiant heat from the halogen lamp 11.

Referring to FIG. 2, a pressure roller 13 facing the cylindrical roller 11 is placed on the bottom of the fusing roller 10 interposing a sheet of paper 14 therebetween. Supported elastically by a spring 13*a*, the pressure roller 13 pushes the sheet of paper 14, which passes between the fusing roller 10 and the pressure roller 13, toward the fusing roller 10 with predetermined pressure. Here, a powder-state toner image 14*a*, which was transferred on the sheet of paper 14, is fixed on the sheet of paper 14 by predetermined pressure and heat when the sheet of paper 14 passes between the fusing roller 10 and the pressure roller 13.

Installed on one side of the fusing roller 10 are a thermistor 15 for measuring the surface temperature of the fusing roller 10 and a thermostat 16 for cutting off the supply of power to the halogen lamp 12 when the surface temperature of the fusing roller 10 exceeds a set value. The thermistor 15 measures the surface temperature of the fusing roller 10 and transmits an electric signal of the measured temperature to a control unit (not shown) of a printer (not shown). Then, the control unit controls power to be supplied to the halogen lamp 12 according to the measured temperature and maintains the surface temperature of the fusing roller 10 within a predetermined range. Furthermore, when the control unit fails to control the surface temperature of the fusing roller 10, leading the temperature of the fusing roller 10 to a temperature higher than a set limit value, a contact (not shown) of the thermostat 16 is opened to cut off power supplied to the halogen lamp 12.

In the meantime, in case of printing continuously while maintaining the fusing temperature of the fusing roller 10 within a predetermined range, the ambient temperature of the fusing roller 10 increases due to the heat generated from the fusing roller 10. In particular, an increase in the temperature of the pressure roller 13 directly leads to an increase in the temperature of the paper passing over the pressing roller 13, which is a major cause of paper creases.

Inside the image forming apparatus is installed a fan, which exhausts hot air to the outside (externally) to lower the internal temperature. The fan cools the inside of the printer to prevent overheating. However, the fan also accelerates the flow of air inside the image forming apparatus, thereby also forming creases in the paper. In particular, more creases in the paper are formed when the temperature of paper is higher than an appropriate fusing temperature.

In order to control a fusing temperature, there has been proposed a method of measuring the temperature of a fusing roller 10 and adjusting the heat from a halogen lamp 12 being a heat source.

However, this method, intended to maintain the temperature of a fusing roller 10 steadily, fails to prevent the creasing of paper because the ambient temperature of the fixing apparatus including a pressure roller 13 rises as a result of a continued use of a printer.

SUMMARY OF THE INVENTION

The present general inventive concept provides an apparatus and method of controlling a fusing temperature of an image forming apparatus that counts a number of sheets of paper printed continuously, which is most closely related to an ambient temperature of a fusing roller, and adjusts a speed of a fan and the fusing temperature accordingly.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a method of controlling a fusing temperature of an image forming apparatus having a fan to ventilate air from or to an outside (externally) of the apparatus, the method including counting an accumulated number of sheets of paper printed in response to print commands, and lowering a set point of a fusing temperature and controlling the fan to increase an amount of air to be ventilated when the accumulated number of sheets of printed paper is greater than a predetermined value.

The above method may include counting the accumulated number of sheets of paper printed in response to print commands, setting a set point of the fusing temperature of a fusing roller at a second value when the accumulated number of sheets of printed paper is equal to or less than a first value, and keeping the fan off; and resetting the fusing temperature of the fusing roller to a third value, lower than the second value, and starting the fan and controlling a fan flow rate at a fourth value when the accumulated number of sheets of printed paper is greater than the first value.

The above method may further include resetting the accumulated number of sheets of printed paper when the image forming apparatus is started or a new print command is received in a power-saving mode, in which the supply of power to a heater of the fusing roller is cut off to save power.

The above method may further include resetting a set point of the temperature of the fusing roller to a sixth value lower than the third value, and controlling the fan flow rate at a seventh value higher than the fourth value, when the accumulated number of sheets of printed paper is greater than a fifth value higher than the first value.

The foregoing and/or other aspects and advantages of the present general inventive concept are achieved by providing an apparatus to control a fusing temperature of an image forming apparatus, the fusing temperature controlling apparatus including a fan which ventilates air from or to an outside (externally), a fan-driving unit which drives the fan, a heater which heats a fusing roller, an AC power supply unit which supplies AC power to the heater, a counter which counts an accumulated number of sheets of paper printed in response to print commands, and a control unit which controls the fan-driving unit to reduce AC power supplied to the heater and increase a fan flow rate when the accumulated number of sheets of printed paper counted by the counter is greater than a predetermined value.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
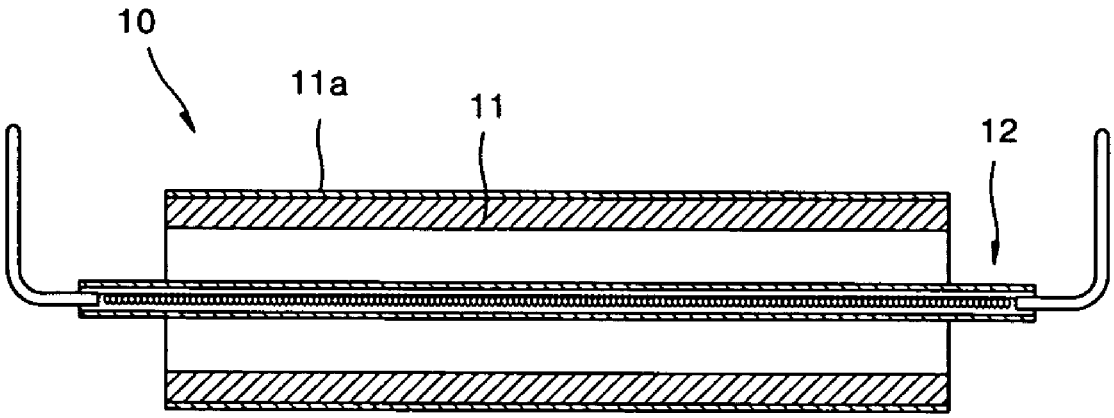
FIG. 1 (PRIOR ART)
FIG. 1 is a horizontal sectional view of a conventional fusing roller using a halogen lamp as a heat source.
Figure 2:
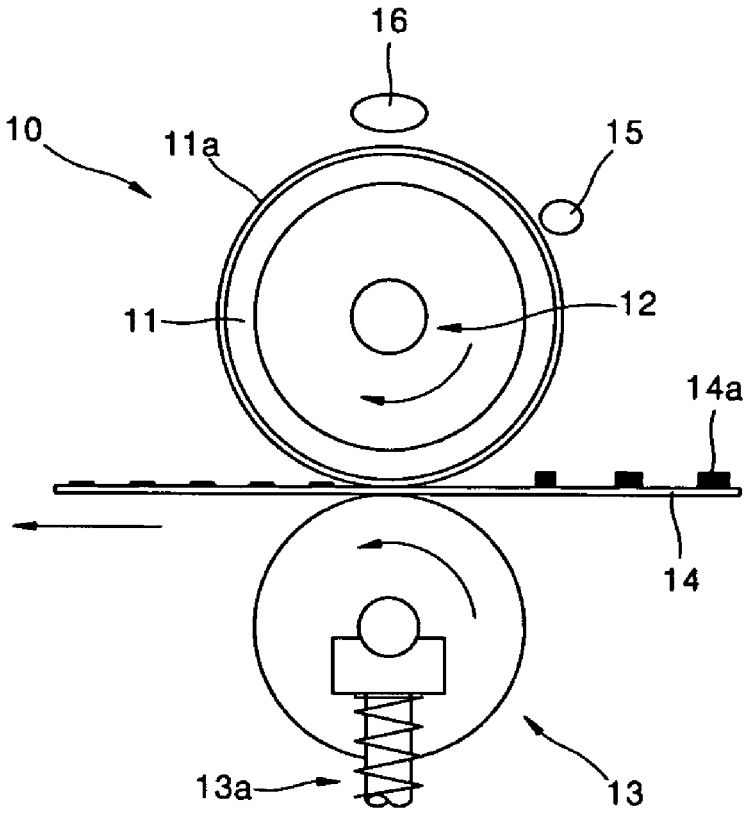
FIG. 2 (PRIOR ART)
FIG. 2 is a vertical sectional view of a fixing apparatus adopting the fusing roller shown in FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
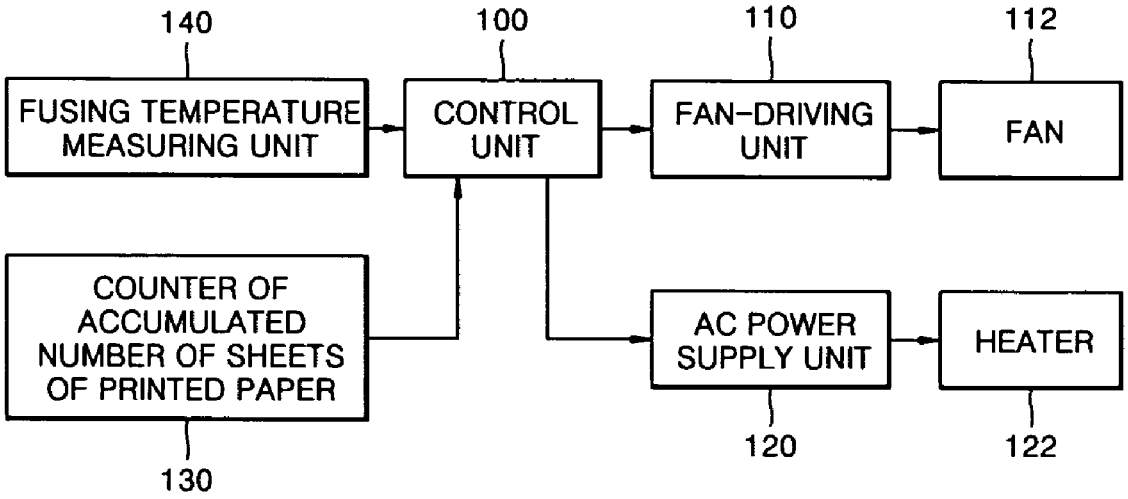
FIG. 3 is a block diagram showing a controlling apparatus to control the fusing temperature of an image forming apparatus according to an embodiment of the present general inventive concept.

FIG. 3 is a block diagram showing a controlling apparatus to control the fusing temperature of an image forming apparatus, according to an embodiment of the present general inventive concept.

Referring to FIG. 3, the controlling apparatus includes a fan 112, a fan-driving unit 110, a heater 122, an AC power supply unit 120, a fusing temperature-measuring unit 140, a counter 130, and a control unit 100.

The fan 112 exhausts air inside an electrophotographic image forming apparatus, such as, for example, a printer (not shown), to lower a temperature inside the image forming apparatus (printer) by indirectly inducing outside air to an inside thereof. One or a plurality of fans can be installed inside the printer. The speed of the fan 112 may be adjusted, depending on printing status of the printer, in order to maintain the temperature inside the printer below an appropriate temperature.

The fan-driving unit 110 controls the speed of the fan 112, or a fan flow rate, according to a control value received from the control unit 100. The control value uses a pulse width modulation (PMW) method, in which a frequency pulse is applied to an element to apply power to the fan-driving unit 110, and the pulse width of a frequency pulse used to run the fan-driving unit 110 is modulated according to the control value. In addition, a duty control method of controlling the time spent for power supply during a predetermined control period may be used. The flow rate of the fan 112 may easily be controlled using either PWM or the duty control method.

The heater 122 being a heat source, which applies predetermined heat to a fusing roller (such as the fusing roller 10 illustrated in FIG. 1), corresponds to the halogen lamp 12 shown in FIG. 1. Additionally, the heater 122 may be a heating coil (not shown) in an instant fusing roller (not shown) using a heat pump. The heater 122 may be applied in various forms. The heater 122 is heated by a predetermined amount of power supplied from the AC power supply unit 120. The fusing temperature-measuring unit 140 measures the temperature, i.e., fusing temperature, of the fusing roller (such as the fusing roller 10 illustrated in FIG. 1), heated by the heater 122. For a precise control of a fusing temperature, one of the above-described PWM and duty control methods may be used as well as an on/off control method.

The counter 130 counts the number of sheets of paper fed into the printer or the number of sheets of paper printed by the printer. This accumulated number of sheets of printed paper is used as a numerical index indicating a temperature increase inside the printer and in the periphery of the fusing roller, caused by continuous printing. Hence, the accumulated number of sheets of printed paper may be counted from the moment when the printer first starts printing or restarts printing after a conversion from a power-saving mode to a printing mode.

Table 1 is an example of a control value of a fan flow rate and a set value of fusing temperature in a case of continuous printing.

TABLE 1

| Accumulated Number of Sheets of Printed Paper | 1~100 | 101~200 | 201 or greater |
|---|---|---|---|
| Fan Flow Rate Control | Fan off | 50% | 100% |
| Fusing Temperature | T | $T-\Delta T_1$ | $T-\Delta T_2$ |

Referring to Table 1, in the initial printing, printing is performed under the condition that a fusing temperature is set at a predetermined value of T (for example, 180° C.). Here, the fan 112 remains turned off because the temperature inside the printer, as well as that of a pressure roller (such as the pressure roller 13 illustrated in FIG. 1), is low even without running the fan 112.

Thereafter, when the accumulated number of sheets of printed paper increases to more than 100 sheets, leading to an increase in the temperature inside the printer and that of the pressure roller (such as the pressure roller 13 illustrated in FIG. 1), the fan 112 runs at a flow rate of about 50 percent to lower the temperature inside the printer, and the set temperature of the fusing roller is lowered by a predetermined value of $\Delta T_1$ (for example, 5° C.).

Later, when the accumulated number of sheets of printed paper increases to more than 200 sheets, leading to an even higher increase in the temperature inside the printer and that of the pressure roller (such as the pressure roller 13 illustrated in FIG. 1), the fan 112 runs fully at a flow rate of 100 percent, and the fusing temperature is lowered by a predetermined value of $\Delta T_2$ (for example, 10° C.).

In Table 1, the number of sheets of paper printed continuously is divided into three sections to adjust a fan control value and a set value of fusing temperature accordingly. For each section, a set value of the temperature of the fusing roller and a fan flow rate are adjusted to prevent a temperature increase inside the printer, resulting from continuous printing, and, consequently, to prevent the formation of creases in paper. Although Table 1 has three sections, the number of sheets of paper printed continuously can be divided into less than or more than three sections depending on the type of the heater 122 within the fixing system of the printer, the control method of the fan 112, and the like.

Meanwhile, the printing stage is classified into a printing mode, a stand-by mode, and a power-saving mode. The printing mode indicates that printing is in progress. In the stand-by mode, the set temperature of the fusing roller is maintained at a predetermined value (for example, below 120° C.) when there is no print command for a predetermined amount of time. The power-saving mode is when power supplied to the heater 122 of the fusing roller 10 is cut off to cool the fusing roller to the room temperature after a long stand-by mode.

The counter 130 may restart when power is applied to a printer or in a case of a conversion from a power-saving mode to a printing mode. In other words, the counter 130 is reset when the power of the printer is turned on or in a case of a conversion from a power-saving mode to a printing mode.

Figure 4:
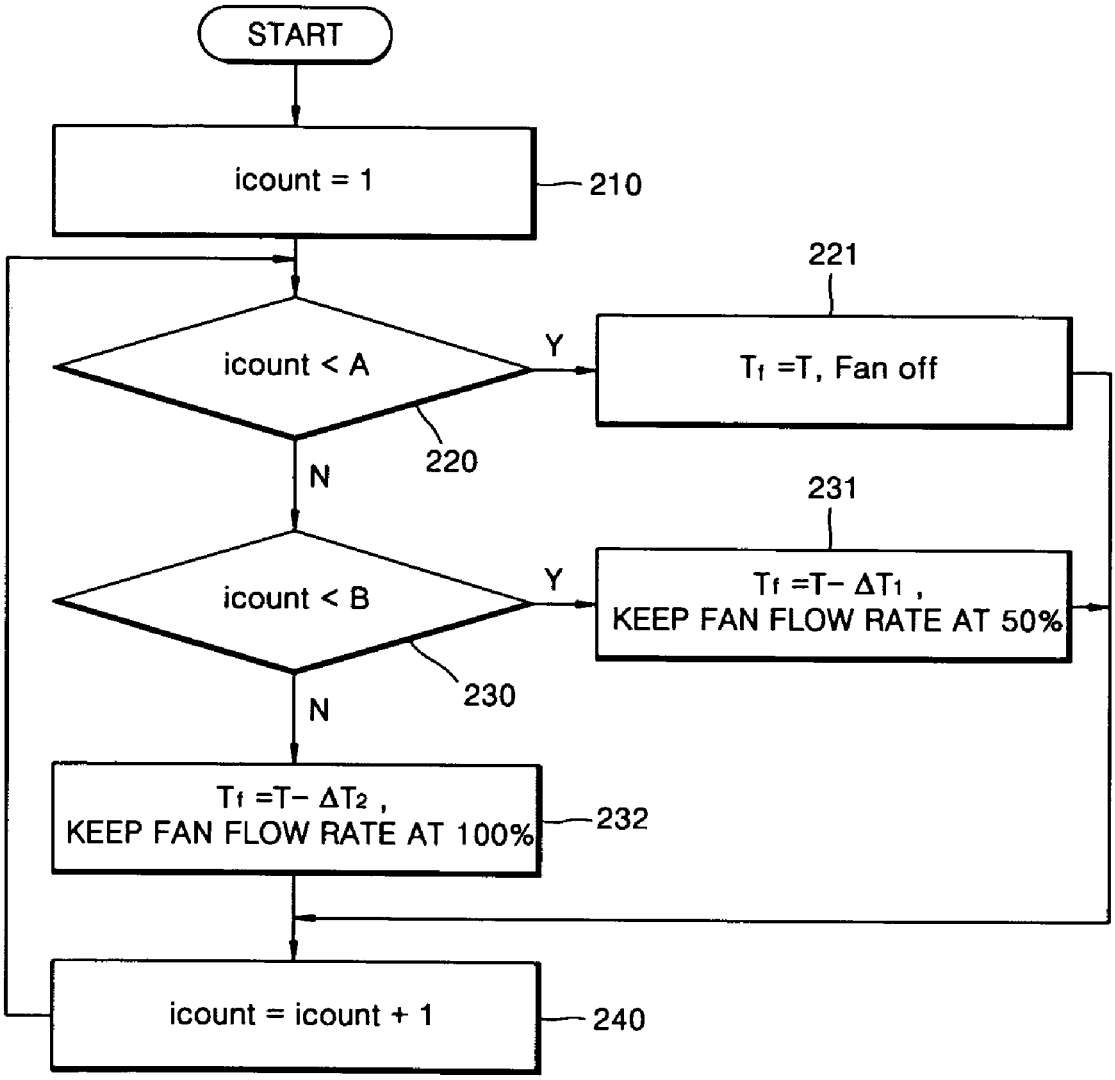
FIG. 4 is a flow chart of a method of controlling the fusing temperature of an image forming apparatus according to an embodiment of the present general inventive concept.

FIG. 4 is a flow chart of a method of controlling the fusing temperature of an image forming apparatus according to an embodiment of the present general inventive concept.

When power is applied to a printer or in the case of a conversion from a power-saving mode to a printing mode, a count icount of the number of sheets of printed paper is reset to "1" (operation 210). Thereafter, the accumulated count of sheets of printed paper icount is compared with a predetermined value of A (operation 220). In operation 220, when the accumulated count icount is less than A, a fusing temperature $T_f$ is set at a predetermined value of T (for example, 180° C.), and a fan motor is kept off (operation 221). Then, the accumulated count icount is increased by "1" (operation 240), and operation 220 is re-performed.

In operation 220, when the accumulated count icount is equal to or greater than A, the accumulated count icount is compared with a predetermined value of B (operation 230).

In operation 230, when the accumulated count icount is less than B, a fusing temperature $T_f$ is set at a value lowered by $\Delta T_1$ from a predetermined value of T (for example, 180° C.) and a fan motor is kept at a flow rate of 50 percent (operation 231). Then, the accumulated count icount is increased by "1" (operation 240) and operation 220 is re-performed.

In operation 230, when the accumulated count icount is equal to or greater than B, a fusing temperature $T_f$ is set at a value lowered by $\Delta T_2$, which is greater than $\Delta T_1$, from a predetermined value of T, and a fan motor is kept at a flow rate of 100 percent (operation 232). Then, the accumulated count icount is increased by "1" (operation 240), and operation 220 is re-performed.

As described so far, the present general inventive concept provides a method of controlling the fusing temperature of an image forming apparatus. According to the method illustrated in FIG. 4, without installing an additional temperature sensor inside a printer, the temperature inside the printer can be presumed and controlled by controlling the fusing temperature of a fusing roller and a fan flow rate to lower the temperature of paper, and consequently, preventing the formation of creases in paper.

The present invention can be realized as a method, an apparatus, and a system. When the present invention is manifested in computer software, components of the present invention may be replaced with code segments that are necessary to perform the required action. Programs or code segments may be stored in media readable by a processor, and transmitted as computer data that is combined with carrier waves via a transmission media or a communication network.

The media readable by a processor include anything that can store and transmit information, such as, electronic circuits, semiconductor memory devices, ROM, flash memory, EEPROM, floppy discs, optical discs, hard discs, optical fiber, radio frequency (RF) networks, etc. The computer data also includes any data that can be transmitted via an electric network channel, optical fiber, air, electro-magnetic field, RF network, etc.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of controlling a fusing temperature of an image forming apparatus having a fan to ventilate an air from or to an outside, the method comprising:

counting an accumulated number of sheets of paper printed in response to print commands;

lowering a set point of a fusing temperature and controlling the fan to increase an amount of air to be ventilated when the accumulated number of sheets of printed paper is greater than a predetermined value;

counting the accumulated number of sheets of paper printed in response to print commands, setting a set point of the fusing temperature of a fusing roller at a second value, when the accumulated number of sheets of printed paper is equal to or less than the predetermined value, and turning the fan off; and resetting the fusing temperature of the fusing roller to a third value, lower than the second value, and starting the fan and controlling a fan flow rate at a fourth value when the accumulated number of sheets of printed paper is greater than the predetermined value.

2. The method of claim 1, further comprising resetting the accumulated number of sheets of printed paper when the image forming apparatus is started or a new print command is received in a power-saving mode in which power supplied to a heater of the fusing roller is cut off to save power.

3. The method of claim 1, further comprising resetting a set point of the temperature of the fusing roller to a sixth value lower than the third value and controlling the fan flow rate at a seventh value higher than the fourth value when the accumulated number of sheets of printed paper is greater than a fifth value higher than the predetermined value.

4. A method of controlling a temperature within an image forming apparatus having therein a fusing unit and a fan to ventilate air into and out of the image forming apparatus, the method comprising:

counting an accumulated number of sheets of paper printed in response to print commands; and controlling a fusing temperature of the fusing unit at a plurality of predetermined temperatures and a speed of the fan at a plurality of predetermined speeds depending on a comparison between the accumulated number of sheets of printed paper and a threshold value, wherein the fusing temperature of the fusing unit is decreased to a first temperature level while the speed of the fan is increased to a first speed when the accumulated number of sheets of paper printed is above a first threshold value, and the fusing temperature of the fusing unit is decreased to a second temperature level while the speed of the fan is increased to a second speed when the accumulated number of sheets of paper printed is above a second threshold value.

5. The method of claim 4, wherein the fusing temperature of the fusing unit is decreased to a third temperature level while the speed of the fan is increased to a third speed when the accumulated number of sheets of paper printed is above a third threshold value.

6. The method of claim 5, further comprising setting a set point of the fusing temperature of the fusing unit at a temperature level higher than the first temperature level when the accumulated number of sheets of printed paper is equal to or less than the first predetermined value, and turning the fan off.

7. The method of claim 6, further comprising resetting the accumulated number of sheets of printed paper when the image forming apparatus is initially started or a new print command is received in a power-saving mode in which power supplied to a heater of the fusing unit is cut off to save power.

8. A control apparatus of an image forming apparatus, the control apparatus comprising:

a fan, which ventilates air from or to an outside;

a fan-driving unit which drives the fan;

a heater which heats a fusing roller;

an AC power supply unit which supplies AC power to the heater and the fan-driving unit;

a counter which counts the accumulated number of sheets of paper printed in response to print commands; and a control unit which controls the AC power supply unit to simultaneously reduce AC power supplied to the heater to one of a plurality of predetermined heating values and to increase AC power to the fan-driving unit to increase a fan flow rate to one of a plurality of fan flow values as the accumulated number of sheets of printed paper counted by the counter corresponds to one of a plurality of predetermined values, wherein the heating value of the heating unit is decreased to a first heating level while the speed of the fan is increased to a first speed when the accumulated number of sheets of paper printed is above a first predetermined value, the heating value of the heater is decreased to a second heating level while the speed of the fan is increased to a second speed when the accumulated number of sheets of paper printed is above a second predetermined value, and the heating value of the heater is decreased to a third heating level while the speed of the fan is increased to a third speed when the accumulated number of sheets of paper printed is above a third predetermined value.

9. An image forming apparatus with a variable internal temperature control, comprising:

a multi-speed fan to ventilate air to and from the inside thereof;

a multi-temperature fusing roller;

a counter which counts an accumulated number of sheets of paper printed in response to print commands; and a control unit which controls the speed of the fan and the temperature of the fusing roller in correspondence to a comparison between the accumulated number of sheets of printed paper counted by the counter and a predetermined threshold value, wherein the fusing temperature of the fusing unit is decreased to a first temperature level while the speed of the fan is increased to a first speed when the accumulated number of sheets of paper printed is above a first threshold value, and the fusing temperature of the fusing unit is decreased to a second temperature level while the speed of the fan is increased to a second speed when the accumulated number of sheets of paper printed is above a second threshold value.

10. A computer readable storage medium having stored therein a method of controlling a fusing temperature of an image forming apparatus having a fan to ventilate an air from or to an outside, the method comprising:

counting an accumulated number of sheets of paper printed in response to print commands;

lowering a set point of a fusing temperature and controlling the fan to increase an amount of air to be ventilated when the accumulated number of sheets of printed paper is greater than a predetermined value;

counting the accumulated number of sheets of paper printed in response to print commands, setting a set point of the fusing temperature of a fusing roller at a second value, when the accumulated number of sheets of printed paper is equal to or less than the predetermined value, and turning the fan off; and resetting the fusing temperature of the fusing roller to a third value, lower than the second value, and starting the fan and controlling a fan flow rate at a fourth value when the accumulated number of sheets of printed paper is greater than the predetermined value.

11. The computer readable storage medium of claim 10, wherein the method further comprises resetting the accumulated number of sheets of printed paper when the image forming apparatus is started or a new print command is received in a power-saving mode in which power supplied to a heater of the fusing roller is cut off to save power.

12. The computer readable storage medium of claim 10, wherein the method further comprises resetting a set point of the temperature of the fusing roller to a sixth value lower than the third value and controlling the fan flow rate at a seventh value higher than the fourth value when the accumulated number of sheets of printed paper is greater than a fifth value higher than the predetermined value.

13. A Computer readable storage medium having stored therein a method of controlling a temperature within an image forming apparatus having therein a fusing unit and a fan to ventilate air into and out of the image forming apparatus, the method comprising:

counting an accumulated number of sheets of paper printed in response to print commands; and controlling a fusing temperature of the fusing unit at a plurality of predetermined temperatures and a speed of the fan at a plurality of predetermined speeds depending on a comparison between the accumulated number of sheets of printed paper and a threshold value, wherein the fusing temperature of the fusing unit is decreased to a first temperature level while the speed of the fan is increased to a first speed when the accumulated number of sheets of paper printed is above a first threshold value, the fusing temperature of the fusing unit is decreased to a second temperature level while the speed of the fan is increased to a second speed when the accumulated number of sheets of paper printed is above a second threshold value, and the fusing temperature of the fusing unit is decreased to a third temperature level while the speed of the fan is increased to a third speed when the accumulated number of sheets of paper printed is above a third threshold value.

14. The computer readable storage medium of claim 13, wherein the method further comprises setting a set point of the fusing temperature of the fusing unit at a temperature level higher than the first temperature level when the accumulated number of sheets of printed paper is equal to or less than the first predetermined value, and turning the fan off.

15. The computer readable storage medium of claim 14, wherein the method further comprises resetting the accumulated number of sheets of printed paper when the image forming apparatus is initially started or a new print command is received in a power-saving mode in which power supplied to a heater of the fusing unit is cut off to save power.

* * * * *